US008408728B2

(12) United States Patent
Fuentes et al.

(10) Patent No.: US 8,408,728 B2
(45) Date of Patent: Apr. 2, 2013

(54) LIGHTED FITTINGS FOR BATHING INSTALLATIONS

(75) Inventors: Luis E. Fuentes, Santa Clarita, CA (US); Graham J. Campbell, Stevenson Ranch, CA (US); Jason W. Hillyard, Fillmore, CA (US)

(73) Assignee: G.G. Distribution and Development Co., Inc., Valencia, CA (US)

( * ) Notice: Subject to any disclaimer, the term of this patent is extended or adjusted under 35 U.S.C. 154(b) by 0 days.

(21) Appl. No.: 13/280,279

(22) Filed: Oct. 24, 2011

(65) Prior Publication Data

US 2012/0099297 A1 Apr. 26, 2012

Related U.S. Application Data

(63) Continuation of application No. 12/039,465, filed on Feb. 28, 2008, now Pat. No. 8,042,962.

(51) Int. Cl.

| | |
|---|---|
| ***F21V 33/00*** | (2006.01) |
| ***F21V 21/00*** | (2006.01) |
| ***F21S 8/00*** | (2006.01) |

(52) U.S. Cl. ..... 362/96; 362/234; 362/249.02; 362/382; 362/457

(58) Field of Classification Search ..... 362/96, 362/101, 234, 249.02, 382, 457
See application file for complete search history.

(56) References Cited

U.S. PATENT DOCUMENTS

| | | | | |
|---|---|---|---|---|
| 5,045,978 | A * | 9/1991 | Gargle | 362/101 |
| 5,486,984 | A * | 1/1996 | Miller | 362/560 |
| 6,886,958 | B1 * | 5/2005 | Grant | 362/101 |
| 6,942,354 | B2 * | 9/2005 | Metayer et al. | 362/101 |
| 8,042,962 | B2 * | 10/2011 | Fuentes et al. | 362/96 |

* cited by examiner

*Primary Examiner* — Alan Cariaso
(74) *Attorney, Agent, or Firm* — Larry K. Roberts

(57) ABSTRACT

A fixture for through hole mounting to a panel includes a flange structure fabricated of a translucent material. The flange structure includes a body portion adapted to extend through a mount hole in the panel and having a outer peripheral portion, and a transverse flange portion having an outer size larger than the hole opening. A periphery flange portion overlaps the panel surrounding the hole when the flange structure is installed in the panel hole. A light source attachment portion is configured to direct light emitted from a light source into the body portion of the flange structure, so that at least some of the emitted light passes into the flange portion to illuminate the flange portion.

13 Claims, 11 Drawing Sheets

LIGHTED FITTINGS FOR BATHING INSTALLATIONS

CROSS-REFERENCE TO RELATED APPLICATION

This application is a continuation of, and claims priority from, U.S. application Ser. No. 12/039,465, filed Feb. 28, 2008, now U.S. Pat. No. 8,042,962 the entire contents of which are hereby incorporated by reference.

BACKGROUND

Bathing installations such as whirlpool baths, spas and pools may include one or more fittings passed through an opening in the wall or surface of bathing installations, e.g., a wall or surface of a water receptacle such as a tub or pool. The fittings may be for air jets, water jets, suction fittings, valves air or electronic controls, cup holders, water features, audio speakers, video displays, or any other fitting passed through a wall of the bathing installation. It may be desirable to provide the fittings with lighting.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
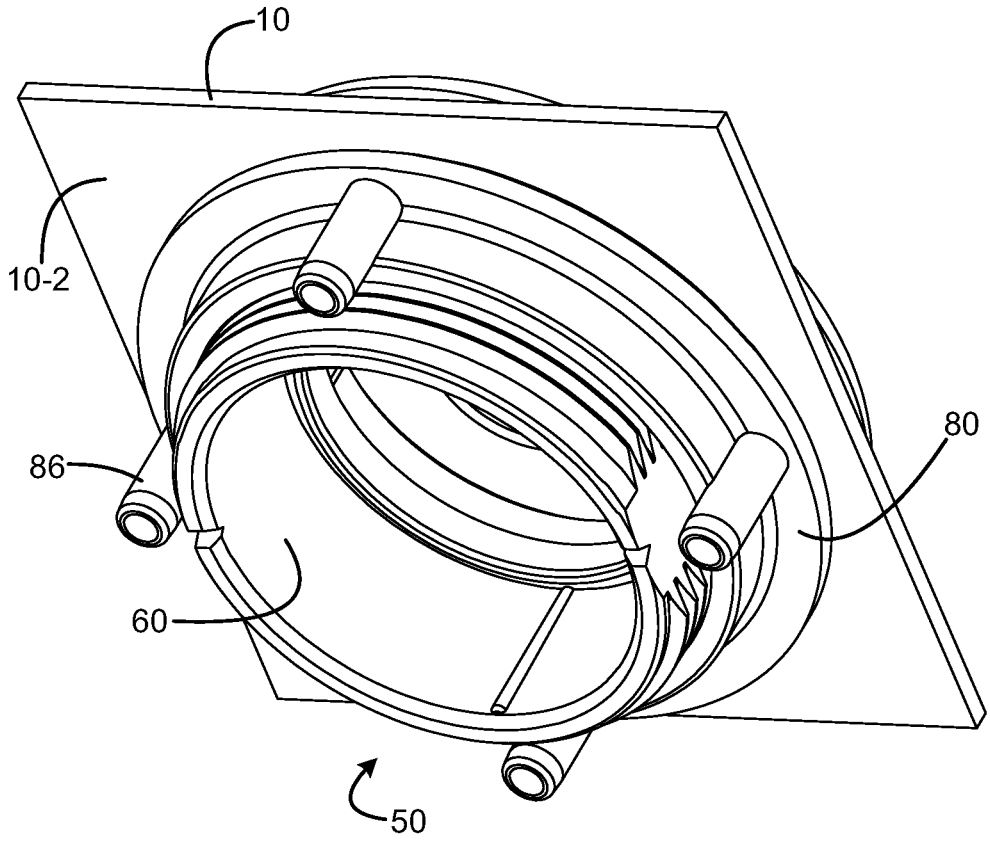
FIGS. 1-2 are front and back isometric views of an exemplary embodiment of a lighted fixture mounted in a panel.
Figure 2:
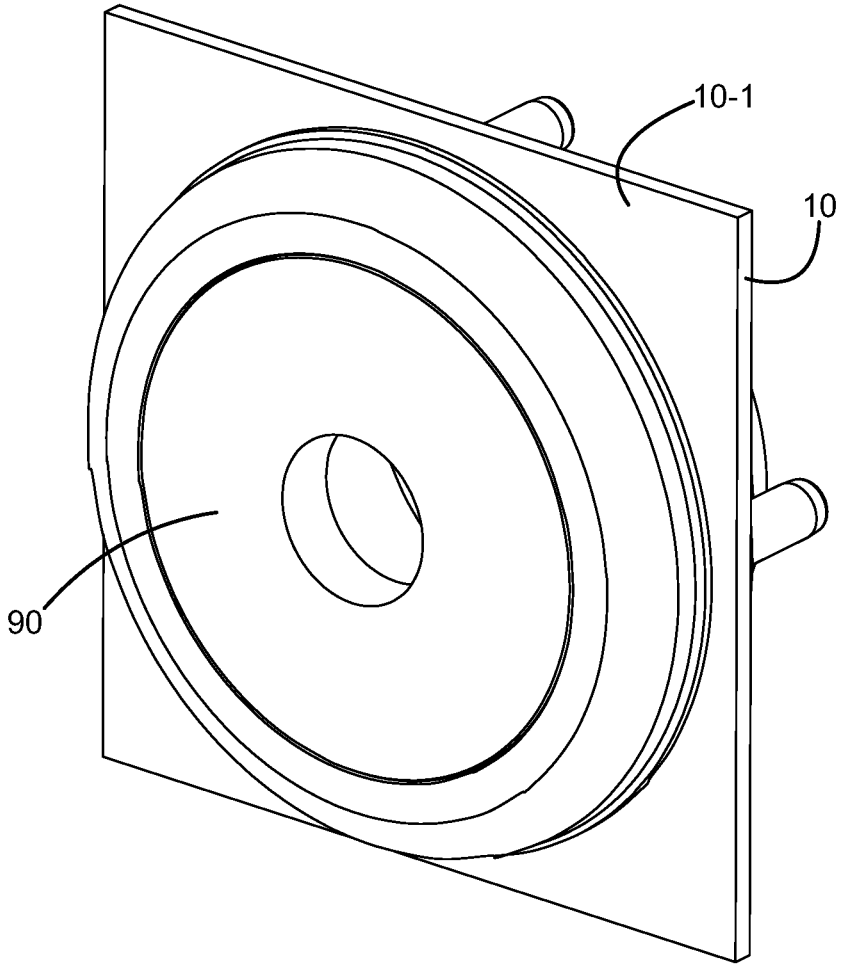

In the following detailed description and in the several figures of the drawing, like elements are identified with like reference numerals. The figures are not to scale, and relative feature sizes may be exaggerated for illustrative purposes.

An exemplary embodiment of a lighted fixture assembly 50 adapted for through-hole mounting in a panel or wall is illustrated in FIGS. 1-6. An exemplary application for the fixture assembly is for mounting in a tub wall 10 (FIG. 1) of a bathing installation such as a spa or whirlpool bath.

Figure 5:
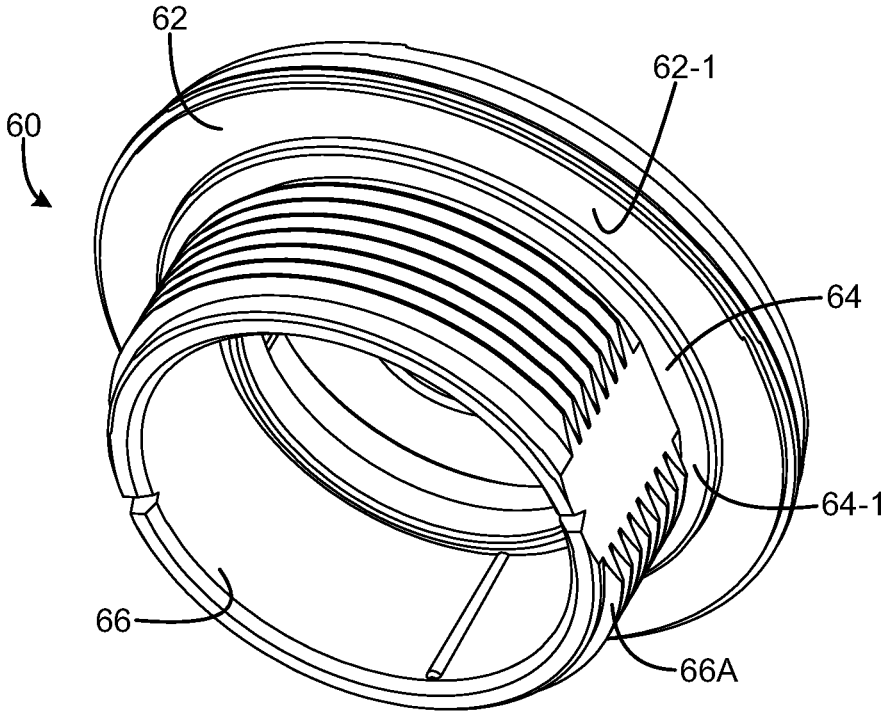
FIG. 5 is an isometric view of a flange structure of the lighted fixture of FIG. 1.
Figure 6:
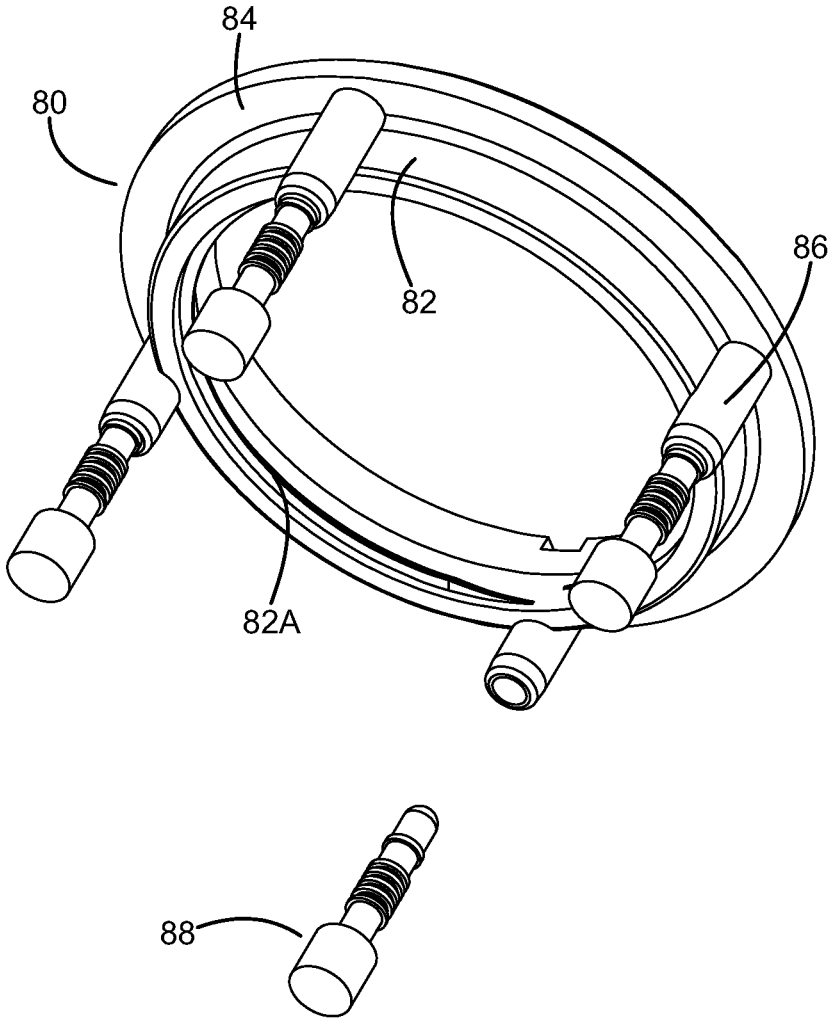
FIG. 6 is an isometric view of an exemplary embodiment of an integrated nut and light fixture structure of FIG. 1 with LED light fixtures in assembled and exploded positions in respect light fixtures of the structure.

The fixture assembly 50 includes a flange structure 60 fabricated from a translucent material such as clear ABS, clear acrylic or clear polycarbonate, and is shown in isolation in FIG. 5. A threaded nut and light source receptacle member 80 is configured to be threaded onto a threaded region of the flange structure, and secure the flange structure in place against the wall 10. Light sources 88 (FIG. 6) such as incandescent bulbs, LED lights or fiber optic fibers connected to a remotely located light source are disposed in receptacles 86 disposed at spaced locations around the periphery of the nut portion of the member 80.

In an exemplary embodiment, the member 80 is also fabricated from a translucent or transparent material such as ABS, clear acrylic or clear polycarbonate. Some of the light generated by the light sources in the light source receptacles is transmitted through the member 80 and the flange structure 60, to provide a lighted assembly visible on the opposite side 10-1 (FIG. 2) of the wall 10 from the side 10-2 (FIG. 1) faced by the nut and light source receptacle member 80.

The flange structure 60 in an exemplary embodiment includes a flange portion 62 and a shoulder portion 64 protruding from a body portion 66 (FIG. 5). The body portion 66 may have a set of threads 66A formed on its outer periphery to engage threads 82A (FIG. 6) of the nut and light source member 80. Alternative embodiments of the flange structure may omit the threads, and the flange structure secured to a corresponding non-threaded member 80 by press-fitting, adhesive or clip-locking. The outer diameter of the body portion 66 is smaller than an opening diameter size of the mounting opening 10-3 (FIG. 3) formed in the wall 10, as is the outer diameter of the shoulder portion 64, so that the body portion 66 and shoulder portion 64 may be fitted into the opening in the tubular portion. The flange portion 62 has an outer diameter larger than the opening diameter, so that the flange portion overlaps onto the wall adjacent the periphery of the wall opening.

Figure 3:
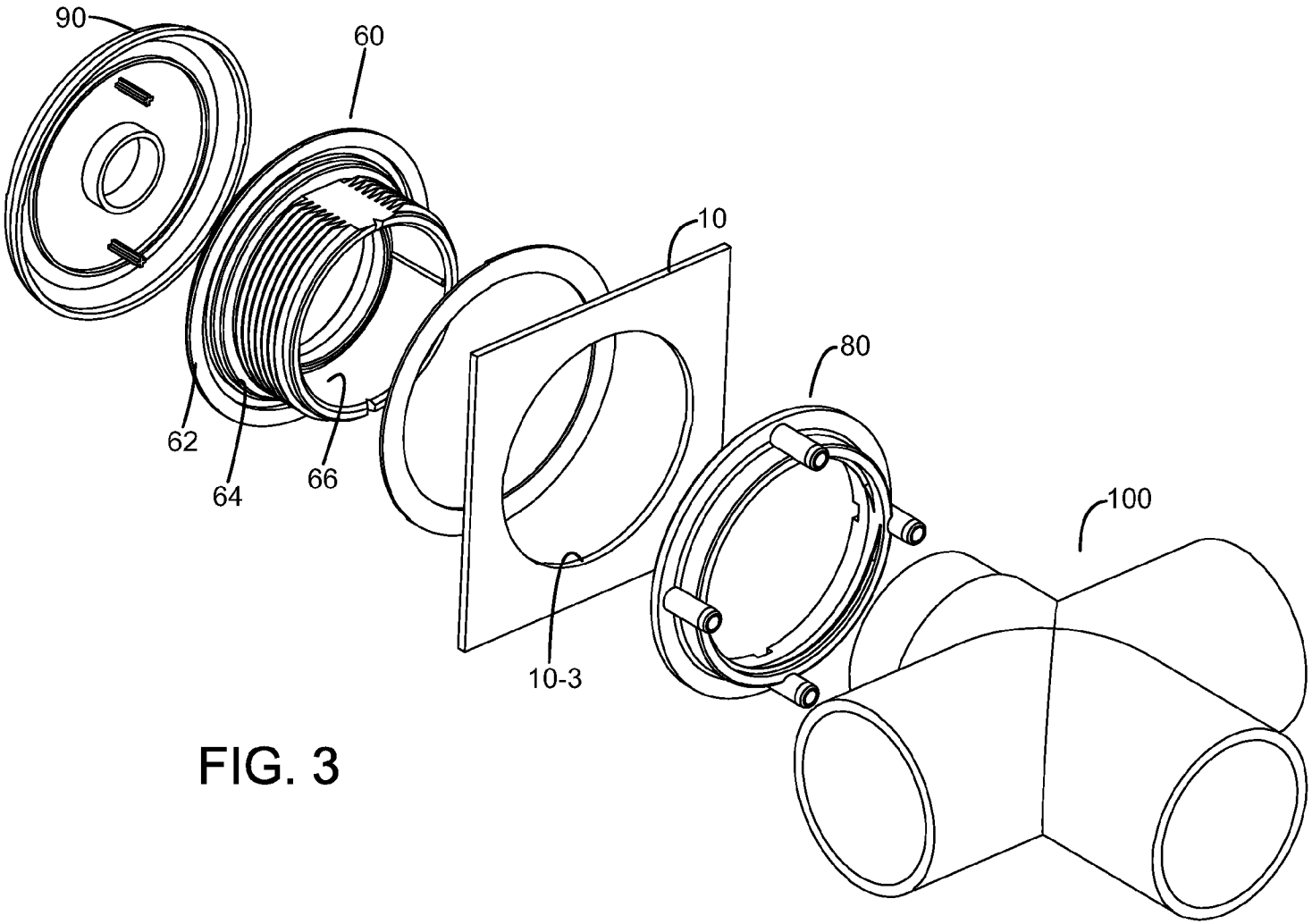
FIGS. 3-4 are exploded front and rear isometric views of an exemplary embodiment of a lighted fixture connected in a bathing installation.
Figure 4:
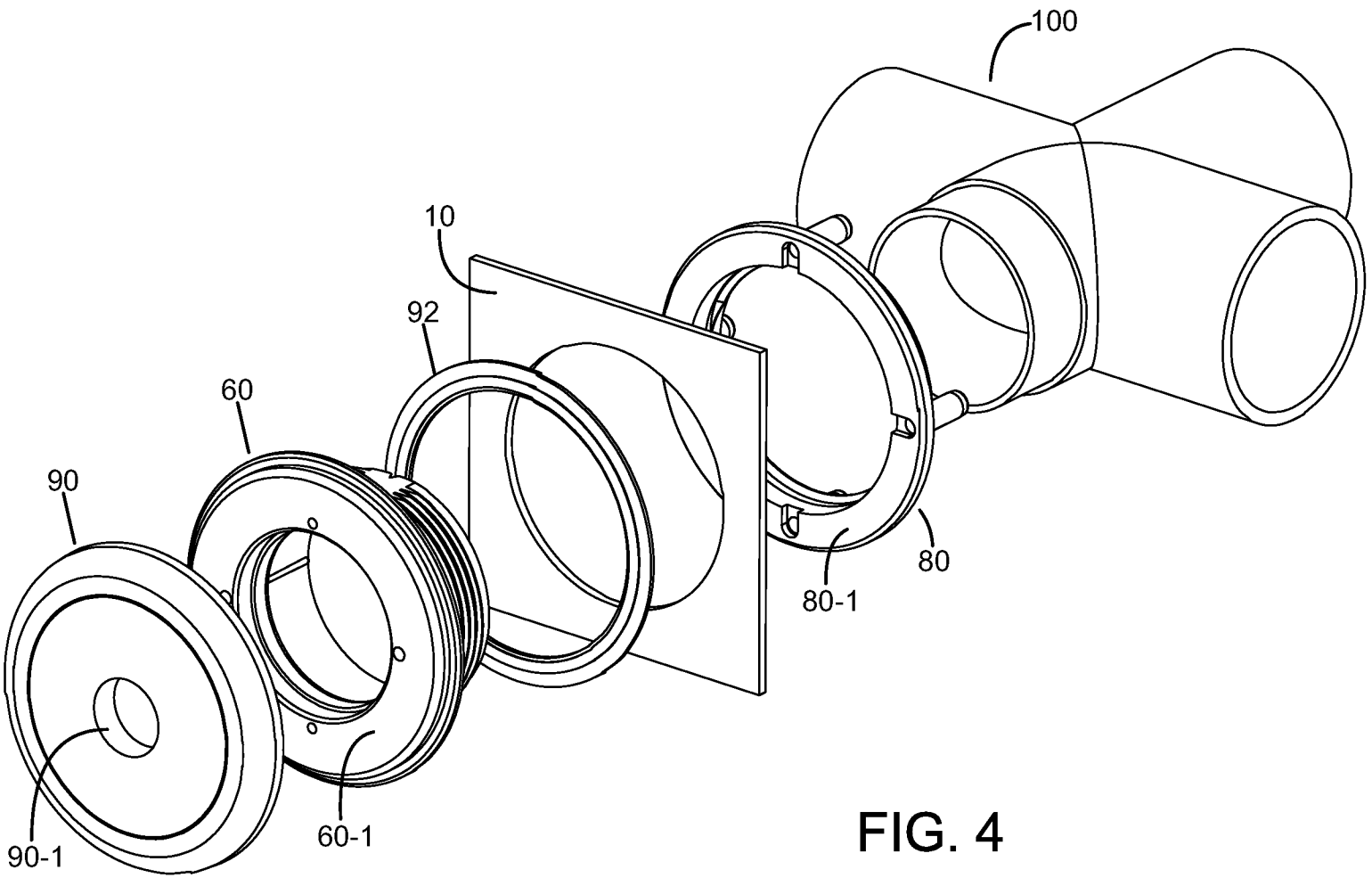

In one exemplary embodiment, the body portion 66 has a hollow generally cylindrical configuration, open at the end distal from the flange portion and adapted to be assembled to a pipe or tube. In one exemplary embodiment, the hollow tubular portion 66 of the flange structure 60 has an inner diameter of two inches to be assembled to a fitting such as a diverter valve structure 100 (FIG. 3). Of course, other applications may employ fittings of other dimensions, and the fitting dimensions of assembly 50 may be modified or scaled appropriately.

In an exemplary embodiment, the shoulder portion 64 of the flange structure has a depth dimension measured from the surface 62-1 (FIG. 5) of the flange portion to the shoulder surface 64-1 (FIG. 5) which may be about equivalent to or preferably slightly less than the thickness of the wall 10. The shoulder portion 64 also has an outer diameter larger than the outer diameter of the tubular portion 66. This allows the facing surface 80-1 (FIG. 4) of the nut and light holder structure 80 to be brought close to the shoulder surface 64-1 when the structure 80 is assembled to the flange structure on a wall mount installation, while allowing the nut member 80 to be tightened on the outer body of the flange structure 60 to secure the assembly in the opening of the wall or surface. To increase the amount of light transmitted through to the flange structure, any space between the facing surfaces 80-1 and 64-1 may be filled with a clear or translucent gel, e.g. an RTV silicon rubber, or a clear gel with a refractive index matching those of the flange structure and the nut assembly. In an exemplary embodiment, light from the light sources 88 in the receptacles 86 is transmitted through the transparent material of the nut structure 80 into the shoulder portion 64 of the flange structure 60, and then through the transparent material of the flange structure 60 to illuminate the surface 60-1 of the flange structure on the opposite side of the wall from the nut and light holder assembly 80.

The assembly 50 may include an end cap 90 which is assembled to the flange structure 60, in an exemplary embodiment in which the assembly is connected to a diverter valve installed in housing 100 connected to a bathing installation water or air pump. The cap 90 may also be fabricated of a transparent or translucent material to allow light from the light sources to be transmitted through the cap. An opening 90-1 permits a handle stem (not shown) from the valve inside housing 100 to protrude, for attachment to a handle for a user to set the valve to a desired position.

An elastomeric gasket 92 (FIG. 4) may be employed as a water seal in some embodiments, and may also be fabricated of a translucent or transparent material. In other embodiments, a transparent curable liquid sealant, e.g. an RTV sealant, may be used to seal the flange structure against the wall 10 instead of, or in addition to, a gasket 92.

With the light receptacles 86 formed as a fixed part of the nut member 80, the light receptacles rotate with the nut member 80 as the nut member is rotated during installation to tighten the nut member against the wall 10. This configuration avoids clearance problems associated with other configurations in which the light receptacles are fixed in a stationary position relative to the wall 10 in a relatively close arrangement relative to the nut member.

In an exemplary embodiment, the light receptacles 86 may be fabricated as a unitary one-piece member with the nut portion of the nut member 80, of a material transparent to visible light. For example, the nut member and light receptacles, as well as the flange structure 60, may be fabricated by injection molding, e.g. of a clear ABS. Alternatively, the light receptacles may be fabricated as separate elements, which are attached to the nut member 80, e.g. by press-fitting into holes formed in the periphery of the nut member, by adhesive attachment or threaded attachment. In an exemplary embodiment, the light sources 88 may be secured in receptacles 86 by interference fit.

Figure 7:
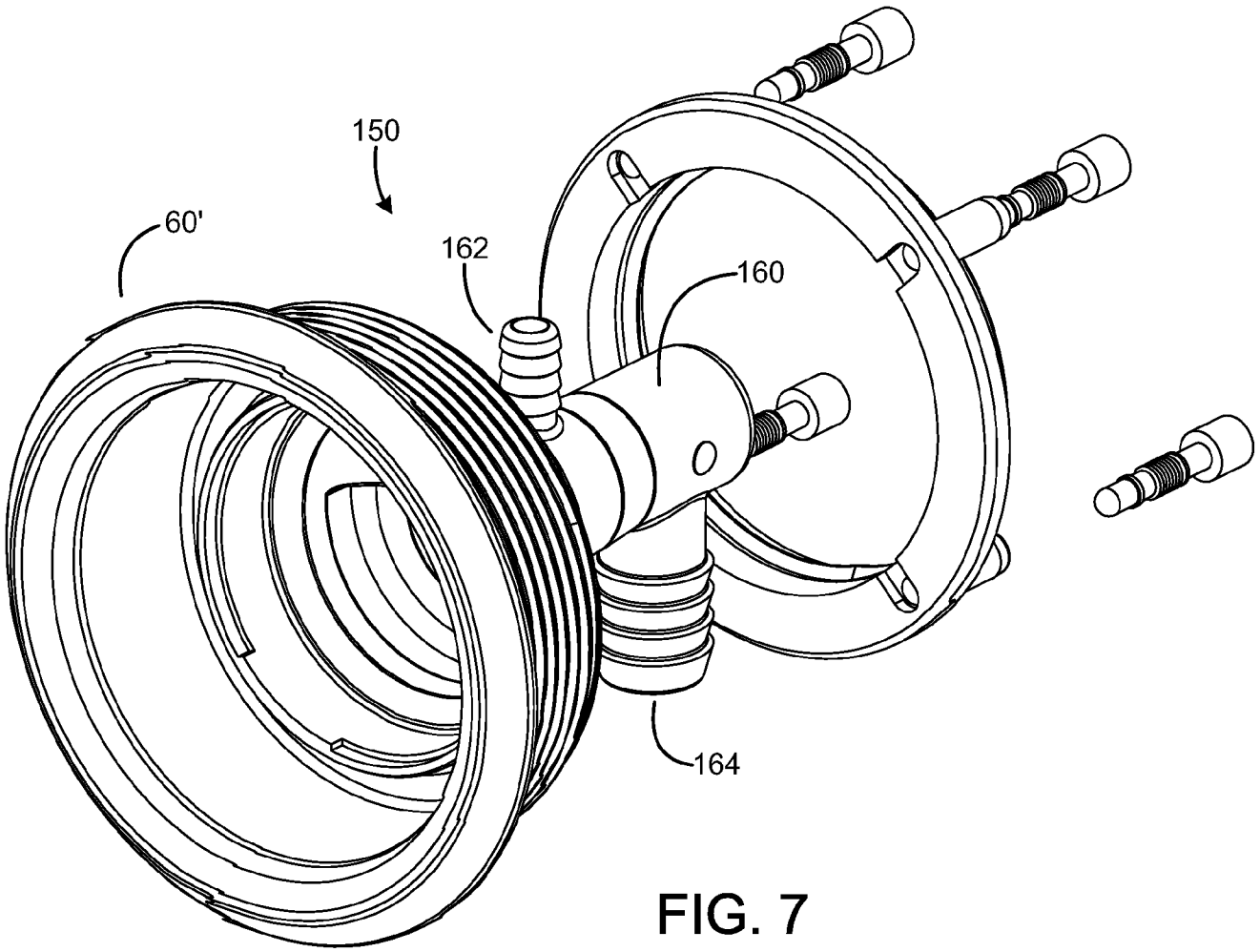
FIGS. 7-8 are isometric exploded views of an alternate embodiment of a lighted fixture for a bathing jet installation.
Figure 8:
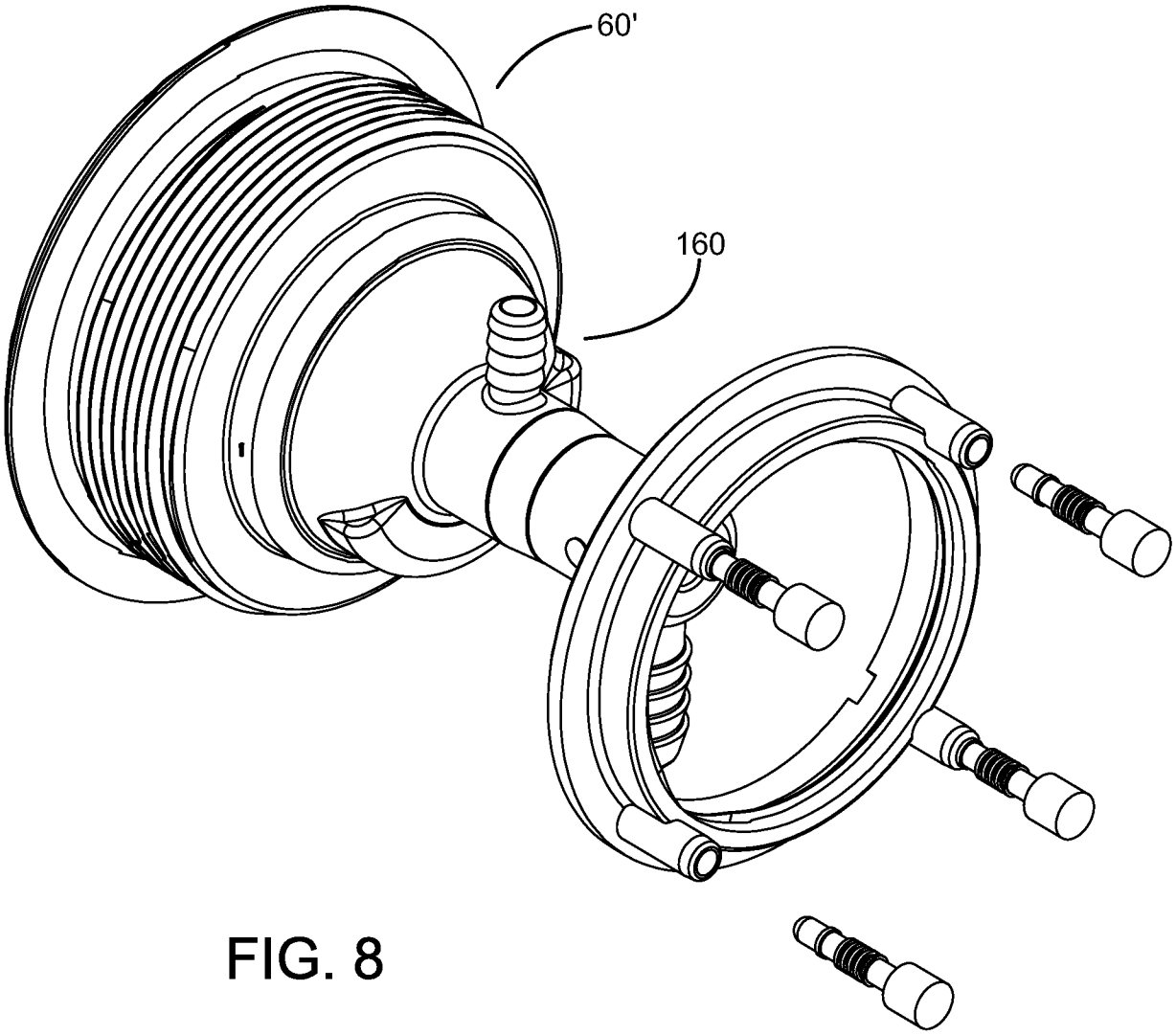

The lighted fixture assembly may be configured for use in various functions other than as a diverter valve connection. For example, FIGS. 7-8 depict a lighted fixture assembly in which the flange portion 60' is adapted for connection to fluid lines. In this example, the flange portion 60' has a closed end region 160 in which are formed two ports 162, 164 for connection to fluid lines (not shown). For example, port 164 may be a water port connected to a water pump through a water line, and port 162 may be an air port connected to an air line. The flange portion 60' may include a jet configured with a venturi, so that water pumped through the jet from the port 164 also draws air from port 162. The connection of the flange portion 60' in this embodiment is by a nut and light holder portion 80, as in the embodiment of FIGS. 1-6.

Figure 9:
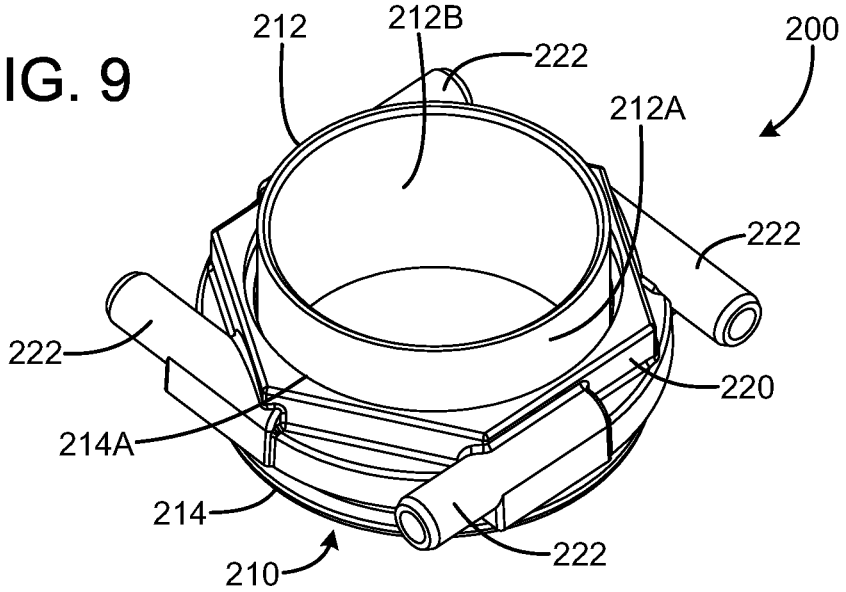
FIG. 9 is an isometric view of another alternate embodiment of a lighted fitting.

FIG. 9 is an isometric view of an alternate embodiment of a lighted fitting 200. As with the embodiment of FIG. 1, for example, the fitting 200 includes a flange structure 210 and a nut and light fitting member 220. In this embodiment, the flange structure includes a body portion 212 and a flange portion 214. The body portion 212 may be inserted through an opening in the wall or surface of the bathing installation, with the flange portion seating against the edge of the wall or surface surrounding the opening. The body portion 212 includes an inner cylindrical surface 2128, and an outer surface 212A. The outer surface 212A is not threaded in this embodiment, nor is the inner surface of the nut and light fitting member 214. Instead, the nut and fitting member 214 is configured for a press fit or slip fit onto the outer surface 212A of the body portion of the flange structure. A final connection can be made by adhesively fixing the member 214 onto the body portion 212A, or by an interference fit.

The nut and light fitting member 214 also differs from the member 80 (FIG. 1) in that the light fittings 222 are oriented in generally tangential directions relative to the interior opening 214A defined by the member 214. Thus, instead of being oriented in a generally perpendicular arrangement relative to the wall 10 (FIG. 1) when the fitting 50 is assembled to the wall, the fittings 222 are oriented in a generally parallel arrangement relative to the wall or surface in which the fitting assembly 200 is installed. This provides the advantage that less clearance room need be provided in a given bathing installation behind the wall or surface. Other orientations of the light fittings 220 may alternatively be employed, e.g., in which the light fittings 220 are oriented at an acute angle relative to the wall or surface, instead of being oriented in a generally parallel relationship.

Figure 10:
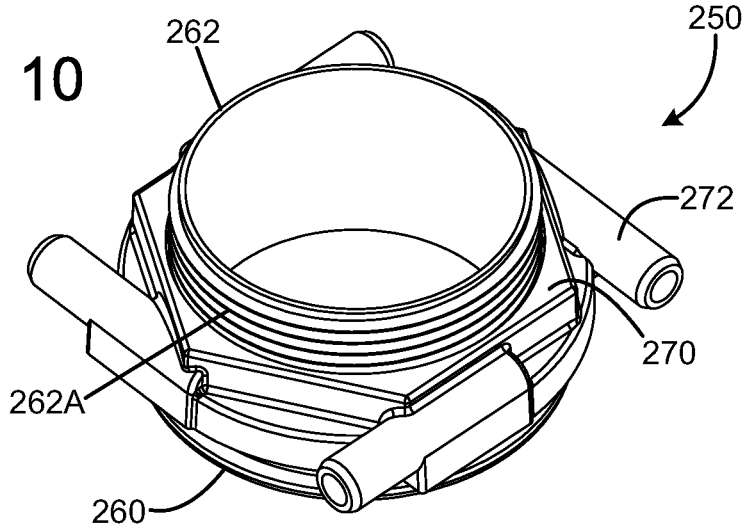
FIG. 10 is an isometric view of yet another embodiment of a lighted fitting.

FIG. 10 is an isometric view of another embodiment of a lighted fitting 250. The fitting 250 is similar to the fitting 200 of FIG. 9, except that the attachment of the nut and light fitting member 270 to the flange structure 260 is by engagement of threads. Thus, the outer peripheral surface 262A of the body portion 262 of the flange structure is threaded, and the inner surface of the nut and light fitting member 270 is threaded as well. The light fittings 272 of the member 270 are disposed in a generally tangential orientation as in the embodiment of FIG. 9.

Figure 11:
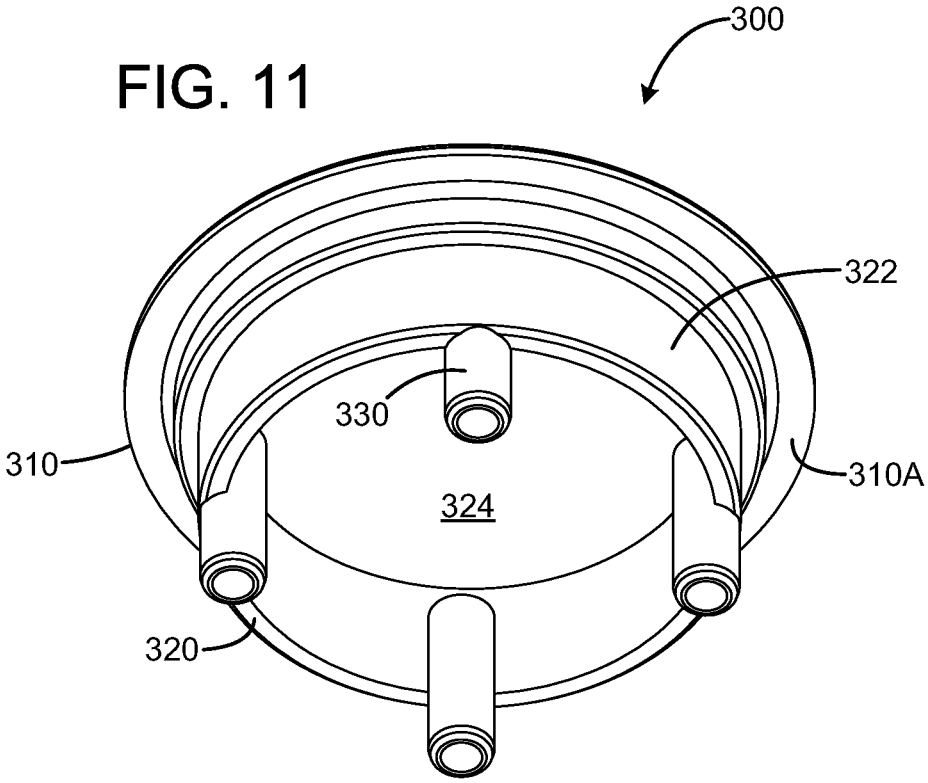
FIG. 11 illustrates an isometric view of a further embodiment of a lighted fitting.

FIG. 11 illustrates an isometric view of a further embodiment of a lighted fitting 300. The fitting 300 does not include a nut member as in the embodiments of FIGS. 1-10. The fitting 300 includes a flange portion 310 and a body portion 320. In an exemplary embodiment, the structure 300 is a one-piece unitary structure, with the flange portion connected at one end of the body portion. The body portion has an interior opening 324, and an outer peripheral surface 320. In this embodiment, the outer peripheral surface has a circular configuration, although other embodiments may be configured with other shapes, e.g. elliptical, oblong, generally rectangular, "snow-man" shaped, and the like. Light fittings or receptacles 330 are disposed in generally tangential orientations on the edges of the body portion 320, and are adapted to hold light sources (not shown in FIG. 11) similar to the light sources 88 described above regarding the embodiment of FIG. 6. The fitting 300 is fabricated from a translucent or transparent material, e.g. clear ABS, clear acrylic or clear polycarbonate. Light from the light sources in the receptacles 330 is passed into the fitting 300, and illuminates the flange portion 310.

The fitting 300 may be inserted in an opening formed in an opening in a wall or surface of a bathing installation, and the flange portion secured to the wall or surface by an adhesive, in an exemplary embodiment. The adhesive may be carried by a gasket structure, or applied in a liquid form when the fitting is inserted into place in the wall opening. The light receptacles 330 are positioned to allow the distal end of the fitting 300 (carrying the light receptacles) to be inserted through the panel opening.

The fitting 300 may be used for various functions, including, by way of example only, a lighted bezel for a cup holder, a fitting for an audio speaker mounted in the open region 324, a lighted bezel for a control device, such as a valve, manual switch or electronic control panel, or a fitting for a display device.

Figure 12:
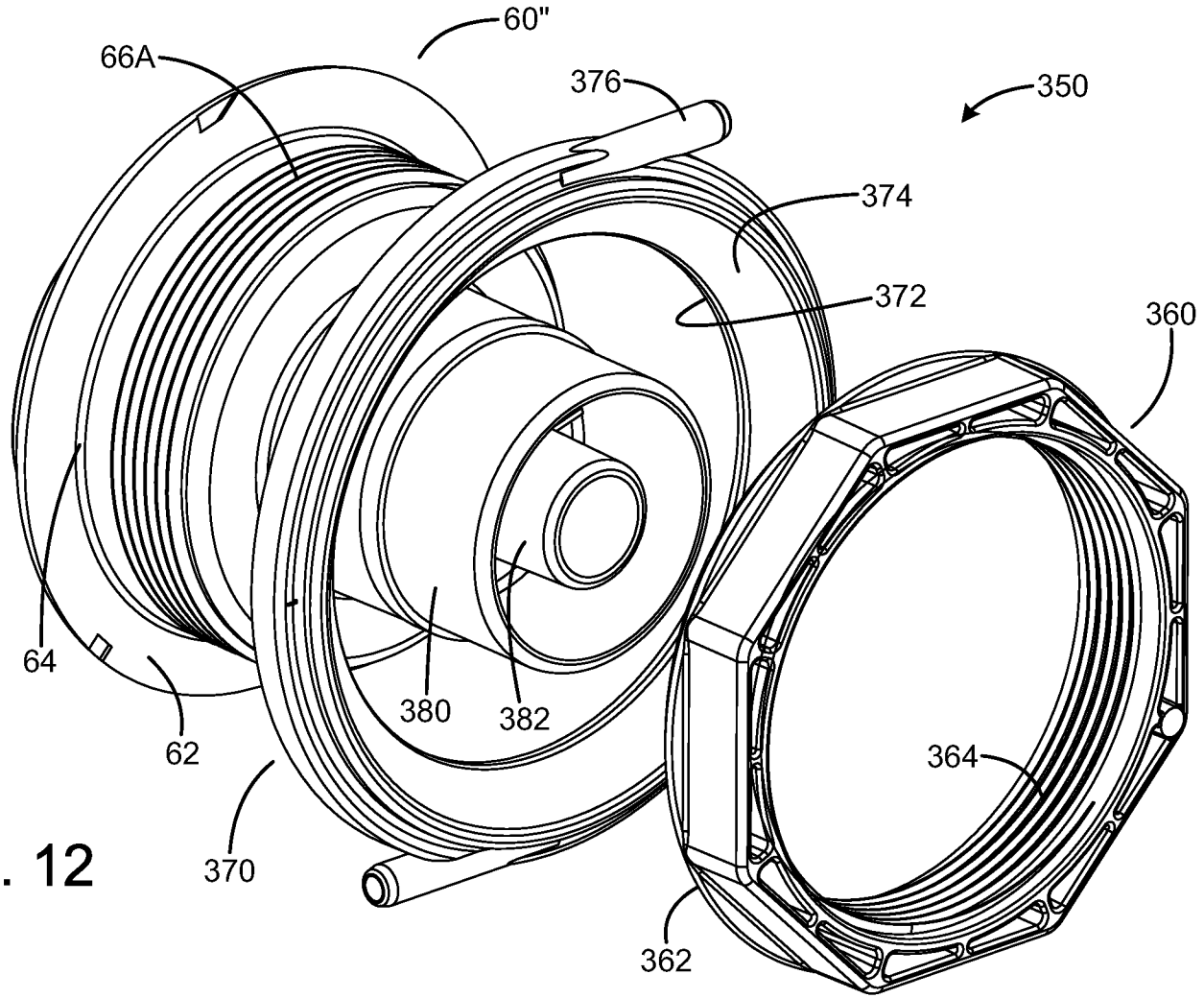
FIG. 12 illustrates an isometric exploded view of another embodiment of a lighted fitting.

FIG. 12 illustrates an exemplary embodiment of a lighted fitting 350 for a bathing installation. The fitting employs a compensation ring structure 370 between the flange structure 60" and a threaded nut 360. The rear surface of the wall of the bathing installation (not shown in FIG. 12) into which the fitting is to be installed may be rough and uneven. The compensation ring structure 370 may be employed to provide compensation between the wall and the facing surface 362 of the nut 360. The facing surface 62 of the flange structure 60" may be planar, as the outside surface of the wall is typically finished and smooth. The surface 372 of the compensation ring may be planar as well, with an opposed concave surface 374. The inner diameter of the ring structure is slightly larger than the outer diameter of the shoulder region 64 of the flange portion. The nut structure 360 includes a facing convex surface 362 and an interior threaded region 364.

When the fitting 350 is assembled into an opening in a wall of a bathing installation, the flange surface 62 is brought against the smooth exterior surface of the wall, the compensation ring 370 is positioned over the threaded portion 66A of the flange structure, and the nut threaded onto the threaded portion 66A and tightened against the ring 370. The respective facing surfaces 374, 362 of the ring and nut allow compensation movement of the ring so that the surface 372 may orient in a cocked relationship relative to the flange structure, depending on the roughness or smoothness of the rear wall surface. If the wall surface is uneven, the surface 372 may not be parallel to surface 62 of the flange structure, yet the nut can be tightened against the ring structure without causing the flange structure to orient in a cocked relationship relative to the wall.

In this exemplary embodiment, the flange structure 60 provides a fitting for a jet structure, and includes cylindrical portion 380 and tube portion 382. The tube portion 380 may be connected to a water line (not shown), and water flows from the water line into the jet through orifice 382.

An exemplary embodiment of the compensation ring 370 includes one or more light receptacles 376 for receiving light sources. The receptacles may be oriented in a tangential fashion as illustrated in FIG. 12, or in another orientation, such as perpendicular or at an acute angle. The tangential orientation positions the sockets away from the nut, reducing the susceptibility to damage caused by wrenches or tools used to tighten the nut on the flange structure.

In an exemplary embodiment, the flange structure 60" and the compensation ring 370 is fabricated from a translucent or transparent material such as ABS, clear acrylic or clear polycarbonate. Some of the light generated by the light sources in the light source receptacles is transmitted through the ring 370 and into the flange structure 60", e.g. through the shoulder region 64, to provide a lighted assembly visible on the opposite side of the wall from the side faced by the nut 360 and ring 370. The nut 360 need not be fabricated of a transparent material in this embodiment, since it is not in the light path from the light sources in the receptacles 376 to the flange structure 60".

While the embodiment of FIG. 12 includes a compensation ring structure and nut with facing surfaces configured to provide movement of the ring to accommodate uneven surfaces, in other embodiments the compensation function may be omitted. For example, the assembly may not include the compensating surfaces on the ring structure and the nut. The lighted function may be provided with a ring or gasket structure and nut with flat surfaces, by including the light receptacles on the periphery of the ring structure as with the ring structure 370.

Although the foregoing has been a description and illustration of specific embodiments of the subject matter, various modifications and changes thereto can be made by persons skilled in the art without departing from the scope and spirit of the invention as defined by the following claims.

What is claimed is:

1. A lighted fitting for through hole mounting to a panel in a bathing installation, comprising:

a flange structure fabricated of a translucent material, the flange structure including a body portion adapted to extend through a mount opening in the panel, and a transverse flange portion having an outer size larger than the mount opening, so that a periphery flange portion overlaps the panel surrounding the opening when the flange structure is installed in the panel opening;

a light source attachment portion configured to direct light emitted from a light source mounted in the light source attachment portion into the body portion of the flange structure, so that at least some of the emitted light passes through the body portion and into the flange portion to illuminate the flange portion, said light source attachment portion configured to be carried by or attached to said body portion so that an installation of said lighted fitting in said panel opening is accomplished without forming a light source opening in the panel separate from the mount opening; and wherein the light source attachment portion is integrally formed with the body portion of the flange structure to form a unitary structure; and wherein the body portion has an outer peripheral surface surrounding an interior opening, the outer peripheral surface terminating in a peripheral edge distal from the flange portion, and wherein the light attachment portion is disposed in a generally tangential orientation on said edge.

2. The fitting of claim 1, wherein the translucent material is one of clear ABS, clear acrylic or clear polycarbonate.

3. The fitting of claim 1, further comprising a light source configured for installation in said light source attachment portion, wherein said light source is one of an LED, an optic fiber or an incandescent bulb.

4. The fitting of claim 1, wherein the outer peripheral surface has a circular configuration.

5. The fitting of claim 1, further comprising an adhesive, wherein the flange portion is configured to be secured to the panel by the adhesive.

6. The fitting of claim 1, wherein the fitting provides one of a lighted bezel for a cup holder, a fitting for an audio speaker mounted in the interior opening, a lighted bezel for a control device, such as a valve, manual switch or electronic control panel, or a fitting for a display device.

7. A lighted fixture for a bathing installation, comprising:

a flange structure fabricated of a translucent material, the flange structure including a body portion adapted to extend through a mount hole in a tub wall of the bathing installation and having a threaded outer peripheral portion, and a transverse flange portion having an outer size larger than the mount hole, so that a periphery flange portion overlaps the tub wall surrounding the mount hole when the flange structure is installed in the mount hole;

a threaded nut member fabricated of a light transmissive material and configured to engage the threaded outer peripheral portion of the flange structure, the nut member having a plurality of integrally formed light source attachment portions, so that with the flange structure mounted to the tub wall with the nut member in engagement with the flange structure, light emitted from light sources mounted in the plurality of light source attachment portions is transmitted through the nut member into the flange structure and through the mount hole in the tub wall to illuminate the transverse flange portion.

8. The fixture of claim 7, wherein the body portion includes a hollow portion.

9. The fixture of claim 7, further including a plurality of light sources installed in respective ones of the plurality of light source attachment portions.

10. The fixture of claim 9, wherein the plurality of light sources includes an LED light source, or an optical fiber.

11. The fixture of claim 7, wherein the light source attachment portion of the threaded nut includes a plurality of holes each formed in a peripheral region of the threaded nut to receive therein a light source.

12. A fitting for through hole mounting to a panel of a bathing installation, comprising:

a flange structure fabricated of a translucent material, the flange structure including a body portion adapted to extend through a mount hole in the panel and having an outer peripheral portion, and a transverse flange portion having an outer size larger than the mount hole, so that a periphery flange portion overlaps the panel surrounding the mount hole when the flange structure is installed in the mount hole;

a connector member configured to engage the outer peripheral portion of the flange structure and secure the flange structure in an installed position in the mount hole;

the connector member having an integrally formed light source attachment portion configured to be positioned outside the outer peripheral portion of the flange structure so that with the flange structure mounted to the panel with the connector member in engagement with the flange structure, light emitted from a light source mounted in the light source attachment portion is transmitted into the flange structure and through the mount hole in the panel to illuminate the transverse flange portion; and wherein the connector member is a threaded nut member for threadingly engaging a set of threads on the flange structure, and the threaded nut member includes a hole formed in a peripheral region of the threaded nut to receive therein a light source.

13. The fitting of claim 12, wherein the threaded nut is fabricated of a light transmissive material.

* * * * *